US006595763B2

(12) United States Patent
Wagner et al.

(10) Patent No.: US 6,595,763 B2
(45) Date of Patent: Jul. 22, 2003

(54) SCREW COMPRESSOR WITH REDUCED LEAK PATH

(75) Inventors: Timothy C. Wagner, East Hartford, CT (US); Alexander Lifson, Manlius, NY (US); James W. Bush, Skaneateles, NY (US); Donald Yannascoli, Manlius, NY (US); Mark Daniels, Manlius, NY (US); Rene Lin, Manlius, NY (US); William Rousseau, Manlius, NY (US)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 10/022,988

(22) Filed: Dec. 18, 2001

(65) Prior Publication Data

US 2003/0113221 A1 Jun. 19, 2003

(51) Int. Cl.[7] ..... F01C 21/00
(52) U.S. Cl. ..... 418/178; 418/201.1
(58) Field of Search ..... 418/178, 201.1

(56) References Cited

U.S. PATENT DOCUMENTS

| | | | | | |
|---|---|---|---|---|---|
| 3,535,057 | A | * | 10/1970 | Kodra | 418/1 |
| 3,827,920 | A | * | 8/1974 | Shimoda et al. | 418/178 |
| 4,188,459 | A | * | 2/1980 | Hyner et al. | 428/648 |
| 4,212,602 | A | * | 7/1980 | Buran et al. | 418/178 |
| 4,269,903 | A | * | 5/1981 | Clingman et al. | 428/591 |
| 4,695,233 | A | | 9/1987 | Miyoshi et al. | |
| 4,724,172 | A | * | 2/1988 | Mosser et al. | 428/469 |
| 5,223,052 | A | | 6/1993 | Yamamoto et al. | |
| 5,314,321 | A | | 5/1994 | Yamamoto et al. | |
| 5,364,250 | A | | 11/1994 | Aoki et al. | |
| 5,530,050 | A | | 6/1996 | Rangaswamy | |

FOREIGN PATENT DOCUMENTS

| | | | | |
|---|---|---|---|---|
| DE | 3609996 | | 10/1987 | |
| GB | 2276422 | | 9/1994 | |
| JP | 56075992 | A * | 6/1981 | F04C/18/16 |
| JP | 56-075992 | | 6/1991 | |
| JP | 3-179190 | | 8/1991 | |
| WO | WO 02 02949 | | 1/2002 | |

* cited by examiner

*Primary Examiner*—Thomas Denion
*Assistant Examiner*—Theresa Trieu
(74) *Attorney, Agent, or Firm*—Bachman & LaPointe, P.C.

(57) ABSTRACT

A screw compressor includes at least two components defining at least two operating zones of different pressure and having surfaces defining a flow point between the at least two zones, and a surface treatment positioned on the surfaces so as to reduce clearance between the surfaces, and thereby reduce leakage through the flow point.

19 Claims, 1 Drawing Sheet

SCREW COMPRESSOR WITH REDUCED LEAK PATH

BACKGROUND OF THE INVENTION

The invention relates to screw compressors and, more particularly, provides a screw compressor adapted to reduce internal leakage paths and therefore to run more efficiently.

Screw compressors contain various components such as rotors which move relative to each other and other components of the compressor including internal surfaces of the housing. Various different surfaces within the compressor define flow points between zones of different pressure, and a compressor in operation can have many such zones. Machine tolerance is required such that the compressor does not rapidly wear and/or malfunction. However, such tolerance or clearance between surfaces, allows leakage through such flow points that adversely impacts upon efficiency.

It is clear that the need remains for improved compressor efficiency without reducing the operational life of the compressor.

It is therefore the primary object of the present invention to provide a compressor which is adapted to operate with reduced internal pressure leakage and therefore at greater efficiency.

Other objects and advantages of the present invention will appear hereinbelow.

SUMMARY OF THE INVENTION

In accordance with the present invention, the foregoing objects and advantages have been readily attained.

According to the invention, a screw compressor is provided which comprises at least two components defining at least two operating zones of different pressure and having surfaces defining a flow point between said at least two zones, and a surface treatment positioned on said surfaces so as to reduce clearance between said surfaces, and thereby reduce fluid flow through said flow point.

BRIEF DESCRIPTION OF THE DRAWINGS

A detailed description of preferred embodiments of the present invention follows, with reference to the attached drawings, wherein.

DETAILED DESCRIPTION

The invention relates to a screw compressor and, more particularly, to a screw compressor having a surface treatment positioned on surfaces of the compressor that define flow points between different pressure zones such that leakage or fluid flow between such zones is reduced, and the compressor thereby operates more efficiently.

Figure 1:
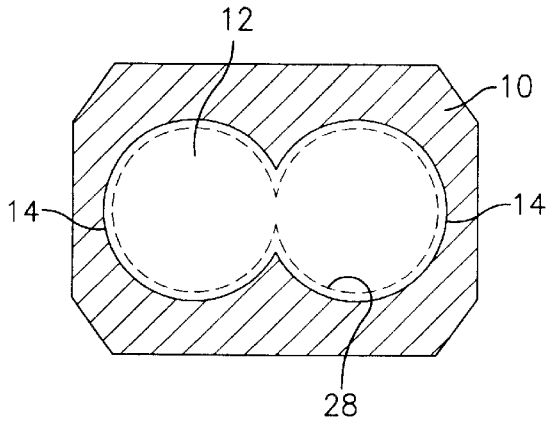
FIG. 1 is a sectional schematic view of a portion of a compressor.

FIG. 1 shows a cross-sectional and schematic view of a typical compressor housing 10 having an internal rotor bore 12 defined by two circular wall portions 14 in which rotors typically are rotatably positioned.

Figure 2:
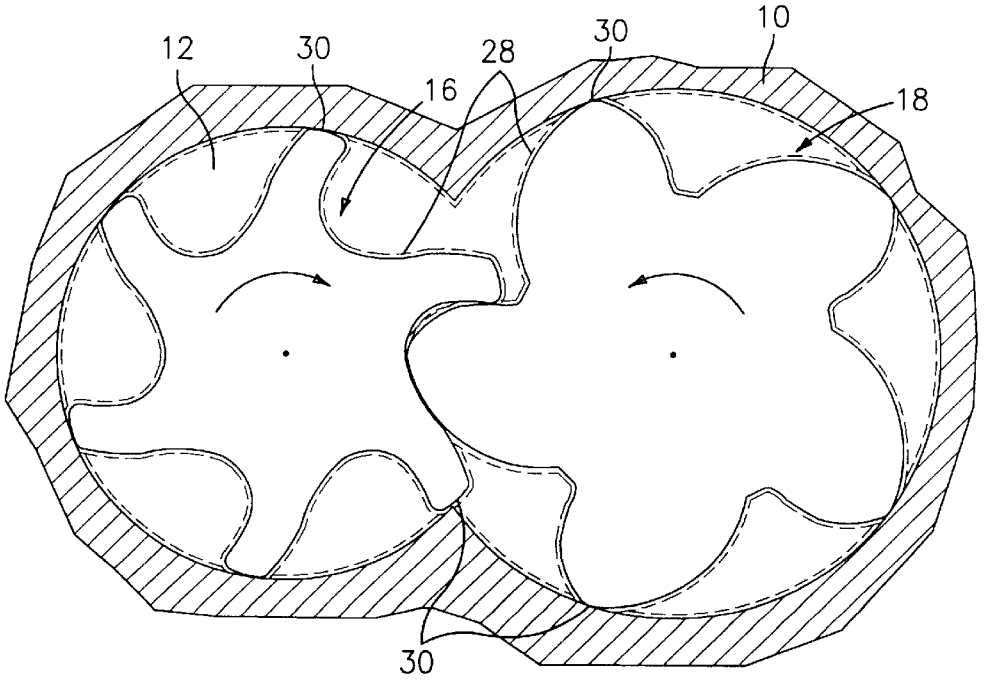
FIG. 2 is a schematic illustration of two rotor components in a compressor housing.

Referring to FIG. 2, rotors 16, 18 are shown positioned within bore 12 of housing 10. During compressor operation, rotors 16, 18 rotate as indicated by arrows in FIG. 2 so as to generate the desired compressed fluid.

Figure 3:
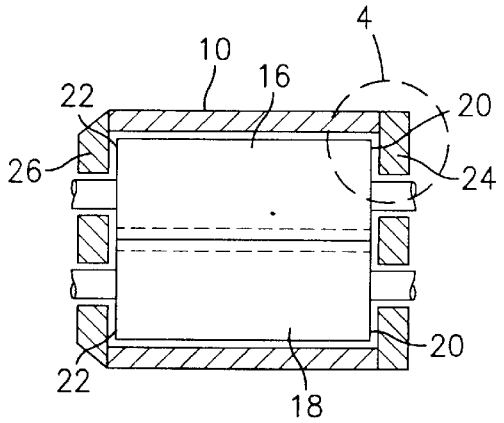
FIG. 3 is a side-schematic view of rotors in a compressor housing.
Figure 4:
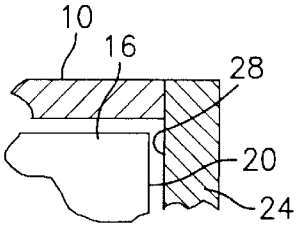
FIG. 4 is an enlarged view of a portion of FIG. 3.

FIG. 3 shows a side schematic view of rotors 16, 18 in a housing 10. As shown, rotors 16, 18 have end faces 20, 22 which typically rotate substantially adjacent to end covers 24, 26 of housing 10. FIG. 4 shows an enlarged portion of FIG. 3 showing a portion of rotor 16 with end face 20 adjacent to an inner surface of end cover 24.

Referring to FIGS. 1–4 collectively, each of these figures illustrates surfaces which, during operation of a compressor, serve to define different pressure zones within the compressor and flow points or leakage points between such zones. In order to prevent excessive wear on compressor components, these surfaces are typically positioned at a sufficient clearance that contact between components does not occur, or occurs minimally, thereby avoiding damage to compressor components due to frictional or even impact contact. Unfortunately, such clearance leads to excessive leakage or flow between zones of different pressure, which reduces compressor efficiency. In accordance with the present invention, a surface treatment 28 is advantageously positioned on at least one and/or both of various surfaces defining flow points or leakage points between such zones so as to reduce clearance between the surfaces and thereby reduce leakage through the flow point.

Referring back to FIGS. 1 and 2, surfaces defining flow points which can advantageously be treated in accordance with the present invention so as to reduce flow or leakage include one or both of wall portions 14 of rotor bores 12 and tips 30 of rotors 16, 18 (shown in connection with rotor 16 only for the sake of simplicity). Positioning of surface treatment 28 on one or both of these surfaces advantageously serves to reduce leakage or flow around the tips of the rotors as desired.

Another flow point or leakage point area is as defined between lobes as they rotate, and surface treatment 28 may advantageously be positioned on one or both surfaces of entire lobes of rotors 16, 18, or at least contacting portions thereof, as shown in FIG. 2, so as to advantageously reduce leakage through such areas as well.

Still another flow point or area where leakage can advantageously be reduced in accordance with the present invention as illustrated in FIGS. 3 and 4 is between end faces 20, 22 of rotors 16, 18 and end covers 24, 26 of housing 10. Here, as well, leakage or flow between different pressure zones can advantageously be reduced in accordance with the present invention.

In accordance with the present invention, the surface treatment is preferably either an elastic material, a conformable material, or an abradable material, all of which can suitably be positioned so as to reduce clearance at the flow point without causing excessive wear on the compressor components.

Elastic material in accordance with the present invention preferably has an elasticity which is greater than the elasticity of the material from which the components are made which define the surfaces at the flow point. Providing surface treatment 28 having such elasticity advantageously allows for much less clearance between surfaces, thereby enhancing efficiency of the compressor, and further reduces or avoids altogether any increase in mechanical wear to the components due to such reduced clearance.

In accordance with a further aspect of the present invention, surface treatment may be provided in the form of an abradable material which can be coated on or otherwise positioned on surfaces of adjacent components such that initial stages of operation of the compressor will partially abrade surface treatment 28 so as to leave a partially abraded surface which has minimal clearance between components, thereby substantially reducing leakage through flow points defined between such treated surfaces. Abradable material in accordance with this aspect of the present invention is suitably a material which is more abradable than the material from which the components are manufactured, and examples of particularly desirable abradable materials for use in accordance with this aspect of the invention include aluminum silicon polyester, porous zirconia, and combinations thereof, or the like. The abradable material is particularly desirable because after a short break-in period the compressor has conformed surfaces which take operating stresses into account and provide excellent reduction in clearance and undesirable flow.

Conformable materials may also suitably be used, for example iron phosphate, nickel zinc alloys, silicon alloys with polyester and the like. Such materials can provide the desired reduction in clearance between moving parts by adapting to the appropriate clearance after a brief break-in period.

The surface treatments may be applied using conventional methods, including chemical vapor deposition (CVD), thermal spraying, electro-plating and the like. The coating thickness is determined based on the clearance of the mating parts and the abradability or conformability of the coating.

As set forth above, the surface treatment 28 may be provided in the form of a coating, or as an insert schematically represented at 28 in FIG. 1, which can be bonded or otherwise fastened, for example mechanically fastened, to surfaces of the components which define the flow point. Depending upon the material of surface treatment 28 the material may eventually need to be replaced. In such an event, the compressor can be disassembled and surface treatment material replaced, for example by replacing the insert comprising the surface treatment, or by removing and re-coating the component, so as to provide a compressor with the desired treated surfaces for continued use. In this way, a compressor is provided which not only operates more efficiently, but which can be readily re-fitted for continued use.

It should also be appreciated that FIGS. 1–4 illustrate several examples of areas where surfaces of components define flow points between zones of different pressure when a compressor is operating. Of course, other surfaces within a compressor could likewise be treated in accordance with the present invention so as to reduce clearance and leakage, well within the scope of the present invention.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed:

1. A screw compressor comprising at least two components defining at least two operating zones of different pressure and having surfaces defining a flow point between said at least two zones, and a surface treatment positioned on said surfaces so as to reduce clearance between said surfaces, and thereby reduce leakage through said flow point, wherein said surfaces are a first material, wherein said surface treatment is an abradable material which is more abradable than said first material of said surfaces, and wherein said abradable material is selected from the group consisting of aluminum silicon polyester, porous zirconia and combinations thereof.

2. The screw compressor of claim 1, wherein said surface treatment is a coating on said substrate.

3. The screw compressor of claim 1, wherein said surface treatment is at least one insert member attached to at least one of said surfaces.

4. The screw compressor of claim 3, wherein said insert is bonded to said surfaces.

5. The screw compressor of claim 3, wherein said insert is mechanically fastened to said surfaces.

6. The compressor of claim 1, wherein said components include a rotor bore and rotors positioned therein, and wherein said surfaces comprise said rotor bore and tips of said rotors, said surface treatment being positioned on at least one of said rotor bore and said tips.

7. The compressor of claim 1, wherein said components are rotors having rotor lobes defining said surfaces, and wherein said surface treatment is positioned on said rotor lobes.

8. The compressor of claim 1, wherein said components are a rotor housing and rotors having end faces, wherein said surfaces comprise said end faces and opposed inner surfaces of said housing, and wherein said surface treatment is positioned on at least one of said end faces and said opposed inner surfaces.

9. The compressor of claim 1, wherein said components are components that move relative to each other during operation of the compressor.

10. A screw compressor comprising at least two components defining at least two operating zones of different pressure and having surfaces defining a flow point between said at least two zones, and a surface treatment positioned on said surfaces so as to reduce clearance between said surfaces, and thereby reduce leakage through said flow point, wherein said surface treatment is a conformable material.

11. The screw compressor of claim 10, wherein said conformable material is selected from the group consisting of iron phosphate, nickel zinc alloys, silicon alloys with polyester and combinations thereof.

12. The screw compressor of claim 10, wherein said surface treatment is a coating on said substrate.

13. The screw compressor of claim 10, wherein said surface treatment is at least one insert member attached to at least one of said surfaces.

14. The screw compressor of claim 13, wherein said insert is bonded to said surfaces.

15. The screw compressor of claim 13, wherein said insert is mechanically fastened to said surfaces.

16. The compressor of claim 10, wherein said components include a rotor bore and rotors positioned therein, and wherein said surfaces comprise said rotor bore and tips of said rotors, said surface treatment being positioned on at least one of said rotor bore and said tips.

17. The compressor of claim 10, wherein said components are rotors having rotor lobes defining said surfaces, and wherein said surface treatment is positioned on said rotor lobes.

18. The compressor of claim 10, wherein said components are a rotor housing and rotors having end faces, wherein said surfaces comprise said end faces and opposed inner surfaces of said housing, and wherein said surface treatment is positioned on at least one of said end faces and said opposed inner surfaces.

19. The compressor of claim 10, wherein said components are components that move relative to each other during operation of the compressor.

* * * * *